US006564787B1

(12) United States Patent
Barry

(10) Patent No.: US 6,564,787 B1
(45) Date of Patent: May 20, 2003

(54) LASER AIMED SLINGSHOT

(76) Inventor: Daniel C. Barry, 1352 Cottage Ave., Conan Station, PA (US) 17728

( * ) Notice: Subject to any disclaimer, the term of this patent is extended or adjusted under 35 U.S.C. 154(b) by 0 days.

(21) Appl. No.: 09/998,188

(22) Filed: Dec. 3, 2001

(51) Int. Cl.[7] ..... F41B 3/02
(52) U.S. Cl. ..... 124/20.1
(58) Field of Search ..... 124/20.1, 20.2, 124/20.3, 25, 87

(56) References Cited

U.S. PATENT DOCUMENTS 1,188,027 A * 6/1916 Widdop
2,501,568 A * 3/1950 Jarnagin
2,715,895 A * 8/1955 Loveless
3,857,379 A * 12/1974 Burghardt
4,050,438 A * 9/1977 Pfotenhauer
4,278,065 A * 7/1981 Wales
5,551,412 A * 9/1996 Warnke ..... 124/20.1

* cited by examiner

*Primary Examiner*—John A. Ricci
(74) *Attorney, Agent, or Firm*—Slater & Cole, LLP; Robert L. Slater, Esq.

(57) ABSTRACT

An improved elastomer driven slingshot device having an adjustably mounted laser beam source adaptable to accommodate both distance to the target and variations in the projectile velocity whereby target accuracy is enhanced.

3 Claims, 5 Drawing Sheets

LASER AIMED SLINGSHOT

BACKGROUND OF THE INVENTION

The present device relates to elastomer driven projectile devices or sling shots and, in particular, to sling shot devices which embody improved means for accurate aiming.

Hand elastomer-driven projectile devices or slingshots for hunting that use energy stored within a strained elastic member or elastomer for propulsion of a projectile have been known and used for centuries. Such hand held slingshot devices are difficult to aim and generally have poor target accuracy.

There are often circumstances wherein a silent non-lethal projectile device is useful. Examples would be found in small game hunting, including non-lethal efforts to discourage small animal invasion of homes and farm animal feeding areas or shelters. A silent non-lethal projectile to anesthetize, discourage, or frighten a non-domesticated small animal such as a racoon, squirrel or other rodent is frequently needed.

A sling shot device with an adjustable energy projectile and improved aim is a useful, silent, and safe alternative to a fire arm for controlling small animal invasions of home and farm property.

Recreational use by children and adults of target aimed devices propelling a safe, non-injurious projectile is widespread. The present invention may be readily adapted to firing non-injurious projectiles with enhanced target accuracy. To overcome the problem of poor accuracy, the invention uses an aiming mechanism employing a laser beam.

There have been numerous earlier projectile devices for propelling bullets, metal balls, arrows, non-lethal plastic projectiles, etc., which have included a light ray or laser beam on to the intended target to assist the marksman. Examples of the earlier devices are: Feldman U.S. Pat. No. 3,614,947 "Arrow Projecting Device with Arrow Projecting Mechanism" wherein the target is illuminated with a light beam directed to the target and attached to the projectile device for nighttime fishing. Lorocco U.S. Pat. No. 6,016,608 "Sighting Device for Projectile-Type Weapons", utilizing an optical fiber light beam improved target accuracy. Moore U.S. Pat. No. 5,621,999 "Externally Mountable Laser Sight with Slide Switch" for illuminating a pistol target with a laser beam.

These and other earlier inventions utilize light beams and laser beams to illuminate a target, however the present invention differs in a novel and important manner from all the earlier disclosed devices. The present invention provides means for the marksman to adjust the laser beam sight to accommodate the parabolic trajectory of his projectile for distance and variable velocity of the projectile based upon the elastomer strain.

SUMMARY OF THE INVENTION

The invention embodies a projectile firing system that uses energy within a strained elastic member (elastomer) to propel a projectile and a laser aiming device to enhance target accuracy. It is fundamental to the physics underlying projectile motion that a projectile fired along a trajectory having a component parallel to the earth's surface travels along a parabolic curve. The deviation of a parabolic trajectory from a flat straight line trajectory depends upon both the initial velocity of the projectile as well as on the distance between the device and the target. It is for this reason that most rifles have a sighting means which may be adjusted to conform the rifle muzzle angle with the estimated parabolic trajectory of a projectile horizontal depending upon the distance to the target.

The particular and unique improvement of the present invention is the placement of an adjustably-mounted laser aiming mechanism on a slingshot that is adapted for firing variable energy projectiles. The laser aiming mechanism of the invention includes an adjustment means in the mounting of the laser beam source onto the slingshot body in order to accommodate variable projectile velocity and the estimated distance to the target in order to improve the target accuracy. Such an improved slingshot would have wide-ranging utility under circumstances in which small animals are the target such as in repelling small animal invasions on farm or home property. Moreover, the accuracy of the system and its capability of firing variable energy projectiles, including non-injurious ones, makes the system suitable in recreational games of skill in which striking moving targets is the objective.

Laser beam sources in past references have been attached to fire arms, bow and arrow devices and other projectile firing devices to improve target accuracy. However, none of these earlier laser beam targeting devices have been adapted for attachment and use with the unique characteristics of sling shot device.

Accordingly, it is an object of the present invention to provide a conveniently adjustable laser beam on a sling shot device for improved target accuracy.

It is an additional object of the invention to provide an elastomeric projectile firing system that uses an adjustable laser-aimed sighting mechanism to increase the accuracy of the system in striking a target with projectiles of variable velocity.

It is another object of the invention to provide a laser aimed elastomeric projectile firing system in which the mounted laser may be readily adjusted to account for the estimated distance to the target and the predetermined initial velocity of the projectile.

DETAILED DESCRIPTION OF THE PREFERRED EMBODIMENT

Figure 1:
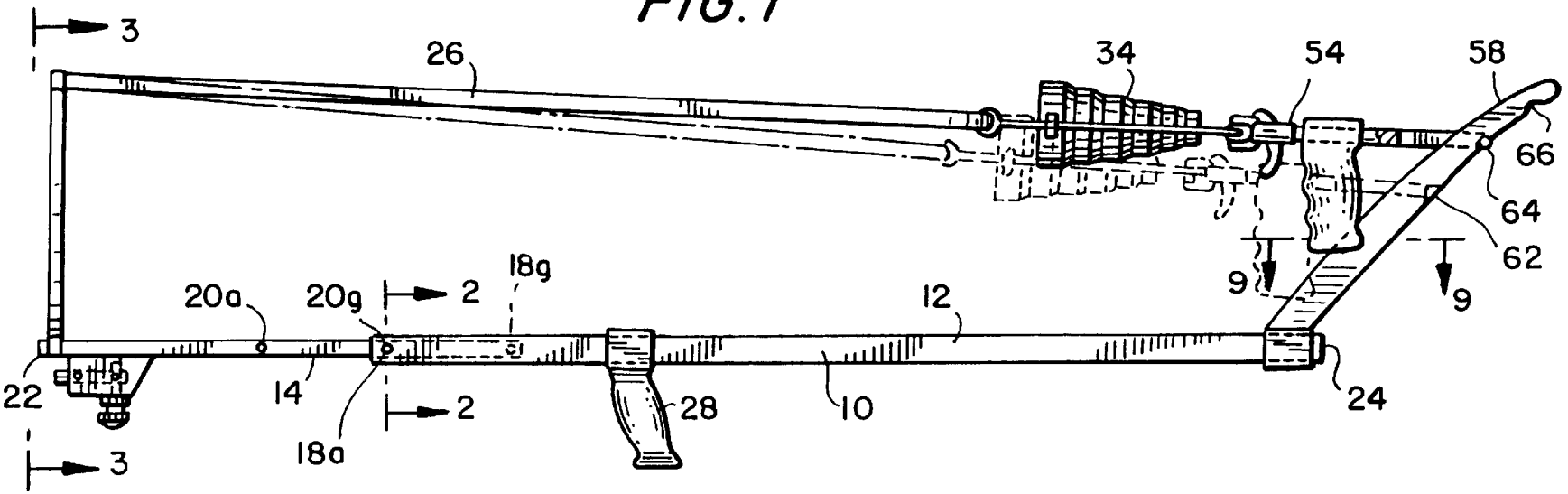
FIG. 1 is an elevation view of the side of a preferred embodiment of my invention.
Figure 2:
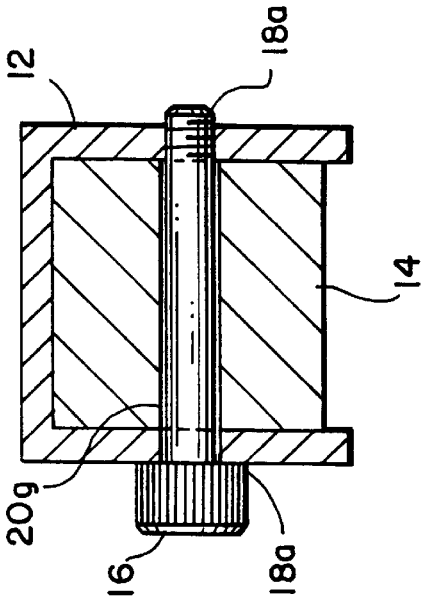
FIG. 2 is a cross sectional view taken on plane 2—2.
Figure 3:
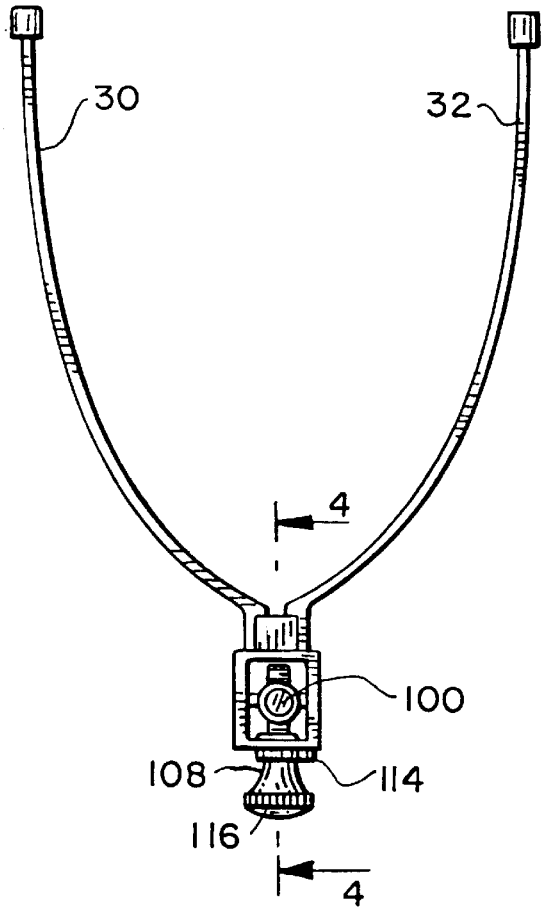
FIG. 3 is a forward or front end elevation view of the of the embodiment of my invention shown in FIG. 1.

Referring to FIG. 1 showing a side elevation view of a preferred embodiment of my improved sling shot device shows a stock 10 comprising an elongated structure upon which other components of my sling shot are mounted. The stock 10 is formed from a U-shaped member 12 into which an extension 14 is mounted within the U-shaped member 12. The extension member 14 is secured in the extension of the stock 10 by means of a threaded bolt 16 which passes through one of several possible apertures 18*a*, 18*b* in the U-shaped member and a corresponding aperture 20*a*,20*b* in the extension member. The aperture 18*a* in the stock member 12 is threaded on one side. The threaded bolt 16 when fully engaged with the threaded aperture 18*a* will secure the stock members 12 and 14 at a selected extension. As will be described below, elastomers, shown in FIG. 1 at 26 of different length and tension may be accommodated with one or another length of the stock 10. Thus propulsion elastomers of different tension and different energy storage capacity may be mounted to my slingshot. The velocity of the projectile of my slingshot is determined by the energy stored when suddenly released when my slingshot is discharged. The stock 10 has a forward front end 22 and a rear end 24.

A handgrip 28 is securely attached to the rear member 12 and extends below the stock 10.

Two brackets 30 and 32 are mounted in parallel relationship to the forward or extension member 14 of the stock 10. The brackets 30 and 32 extend well above the upper side of the stock 10.

Figure 6:
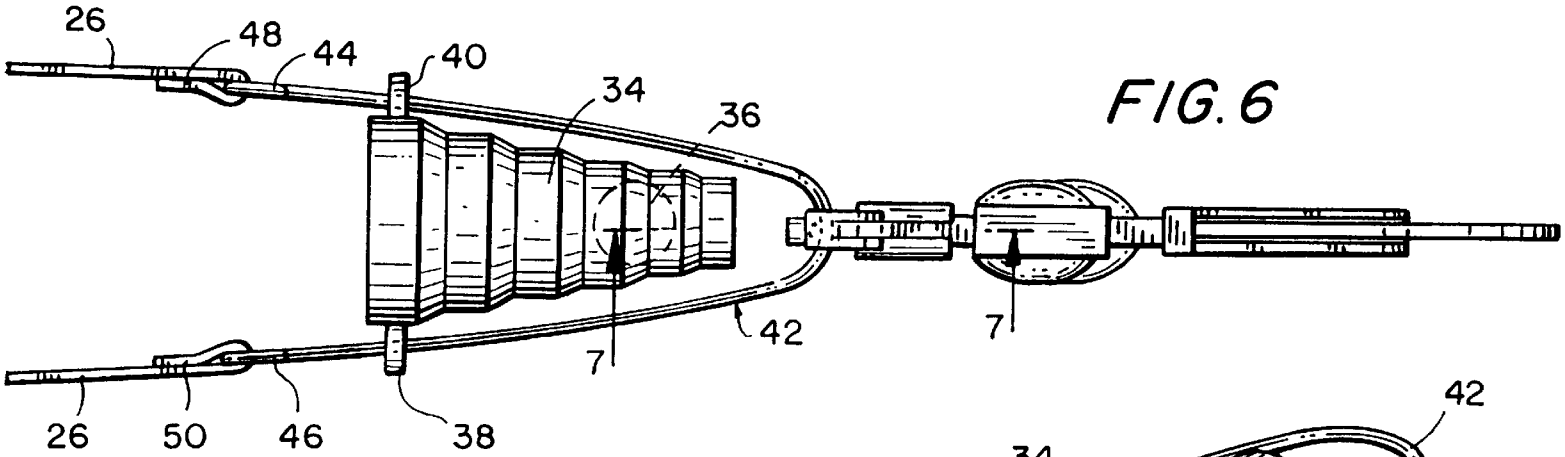
FIG. 6 is a fragmentary plan view of a release mechanism of the embodiment of my invention as illustrated in FIG. 1.
Figure 9:
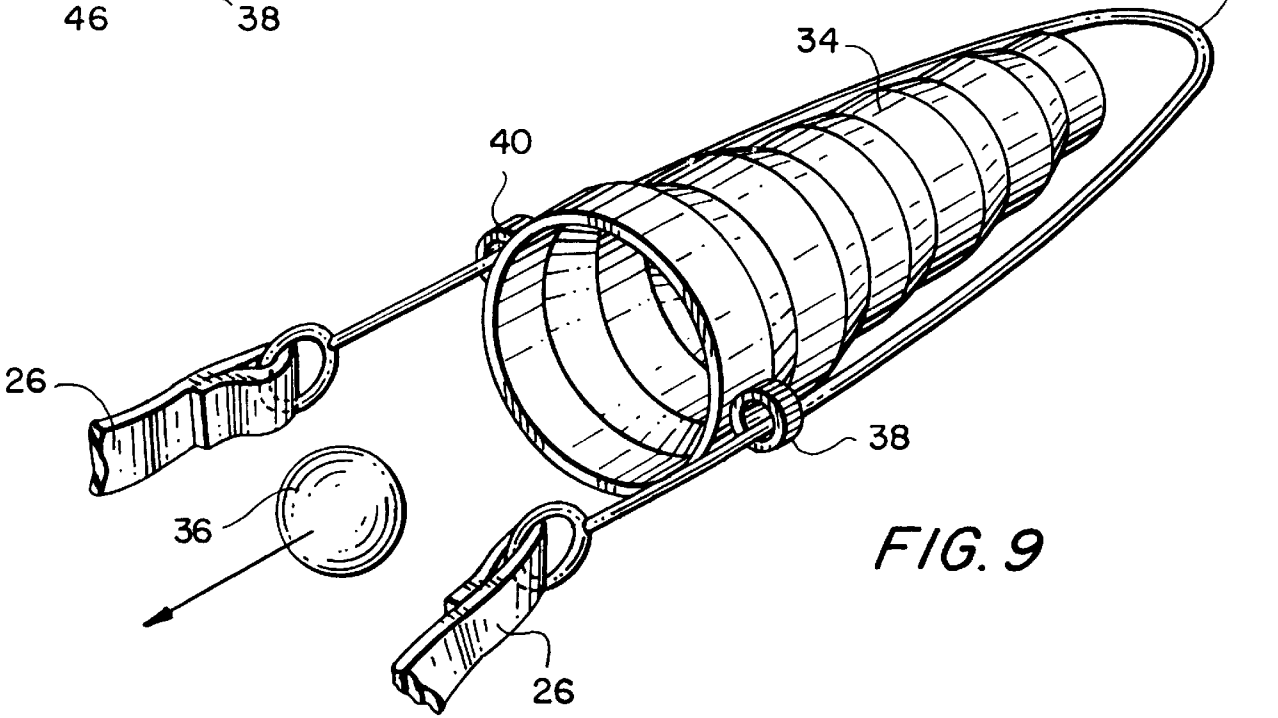
FIG. 9 is a fragmentary perspective view showing component parts of my invention at the instant of release of a projectile.

FIGS. 6 and 9 illustrate a molded projectile pouch 34 for holding a projectile 36 preparatory to the release of the projectile. The pouch 34 is secured with small loop elastomers 38,40 to a flexible cord 42. The flexible cord may be formed from woven wires or a woven hemp rope material. The respective ends of the flexible cord 44,46 are secured to the respective ends 48,50 of the elastomer 26.

A trigger assembly 54 is adjustably mounted onto an extension 58 of the stock 10. The stock extension 58 is positioned on the upper side and at the rear 24 of the stock 10. The extension 58 is planar, curved, and provides variable vertical and variably rearwardly horizontal means for attaching the trigger assembly 54. The extension 58 is accordingly provided with spaced indentations 62,64,66 for attaching the trigger assembly 58. The horizontal spacing between the indentations 62,64,66 provides means for lengthening the distance between the brackets 30,32 and the trigger assembly 54, between which the elastomer 26 is suspended in tension ready for discharge by action of the trigger assembly. The maximum tension and therefore maximum energy storage in the elastomer 26 is obtained by positioning the trigger assembly 58 onto the most rearward indentation 66.

The trigger assembly 58 is comprised of a cylindrical case 68. The case 68 may be molded polymer or metal. A moderately hardened flexible rubber retaining member 70 is positioned within the case 68. Th retaining member 70 is provided with a forward extension 72, the forward extension 72 is provided with a horizontal recess 74.

A trigger 78 is pivotally mounted within the case by means of a pinion 80 slidably assembled in an elongated horizontal opening 82 in the trigger 78.

Two metal spheres (ball bearings) 76,77 are imbedded in spaced opposition in the walls of the recess 74. When positioned within the case the recess is narrowed, the metal spheres are forced into contact. The flexible cord 42 is positioned in the recess 74 behind the metal spheres 76,74 and thus held in place in preparation for discharge. When the rubber retainer forward extension is forced out of the trigger case 68 the recess 74 is widened, the metal spheres 76,77 are separated, and the flexible cord 42 is released.

Figure 7:
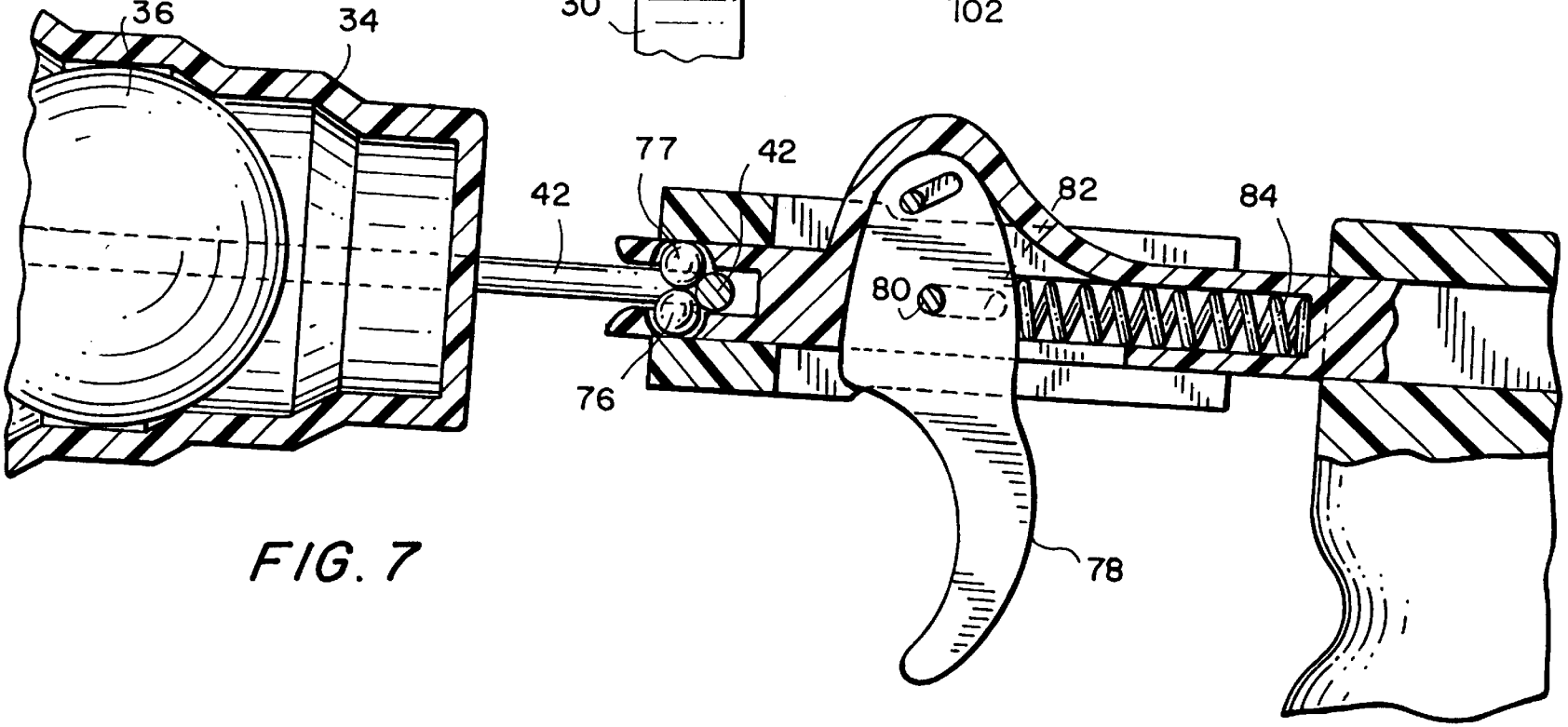
FIG. 7 is a cross sectional view taken on plane 7—7 of the trigger release mechanism in a cocked ready to fire position.

A spring 84 placed within the case 68 rearward of the trigger assists the trigger 78 when actuated or pulled to force the rubber retainer member 70 forward and the retainer extension 72 is then forced out of the case. This action is readily seen by observing FIGS. 7 and 8. The trigger assembly 54 includes a handle 86 and a flexible retaining means 88 for adjustably attaching the trigger assembly 54 to one of the indentations 62,64,66 of the stock extension 58.

Figure 8:
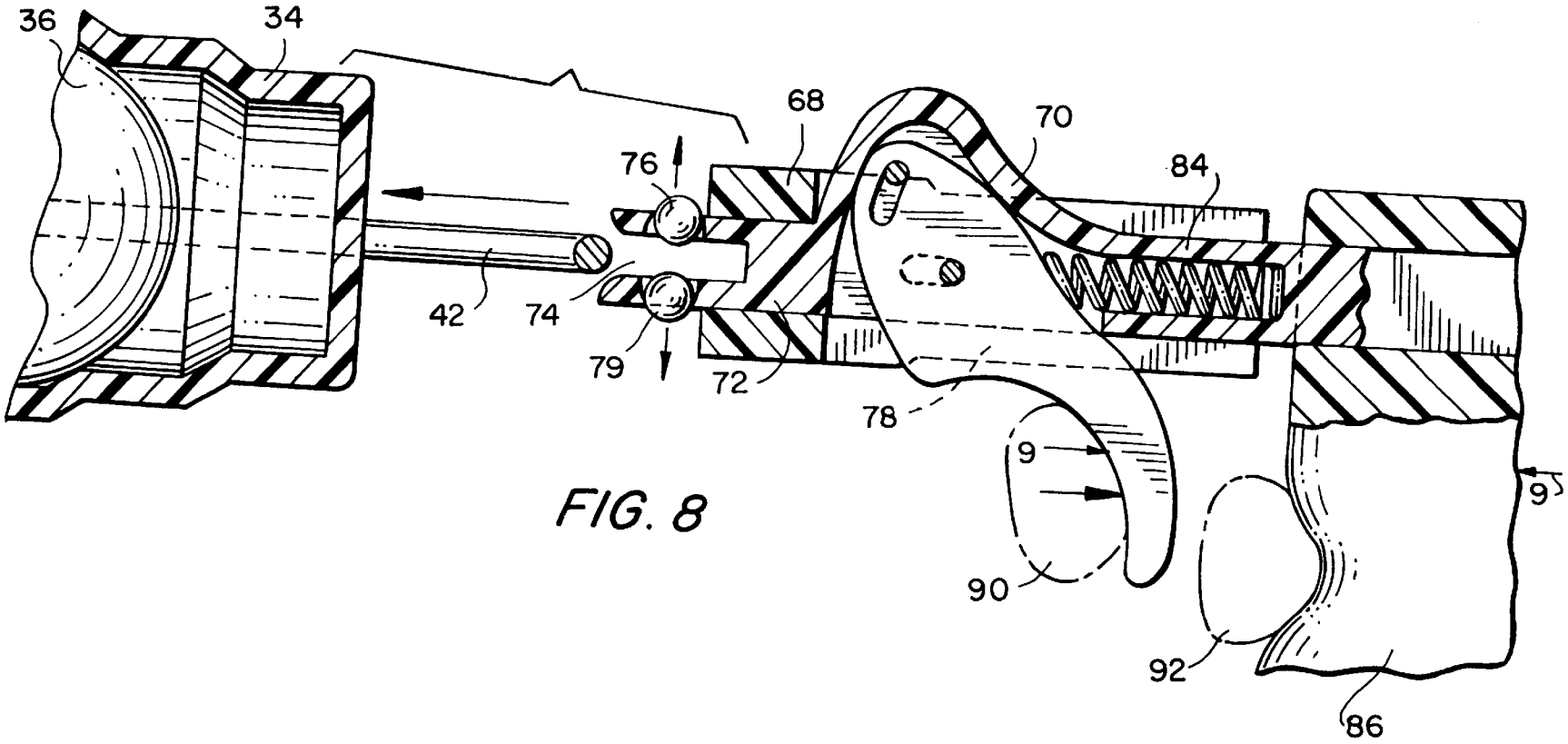
FIG. 8 is a cross sectional view taken on plane 7—7 of the trigger release mechanism in a just released fired position.

FIG. 8 is a cross section view showing at the instant of discharge the positions of the rubber retaining member 70, the trigger 78, the marksman's first finger 90 on the trigger 78, and the marksman's second finger 92 on the handle 86.

Figure 4:
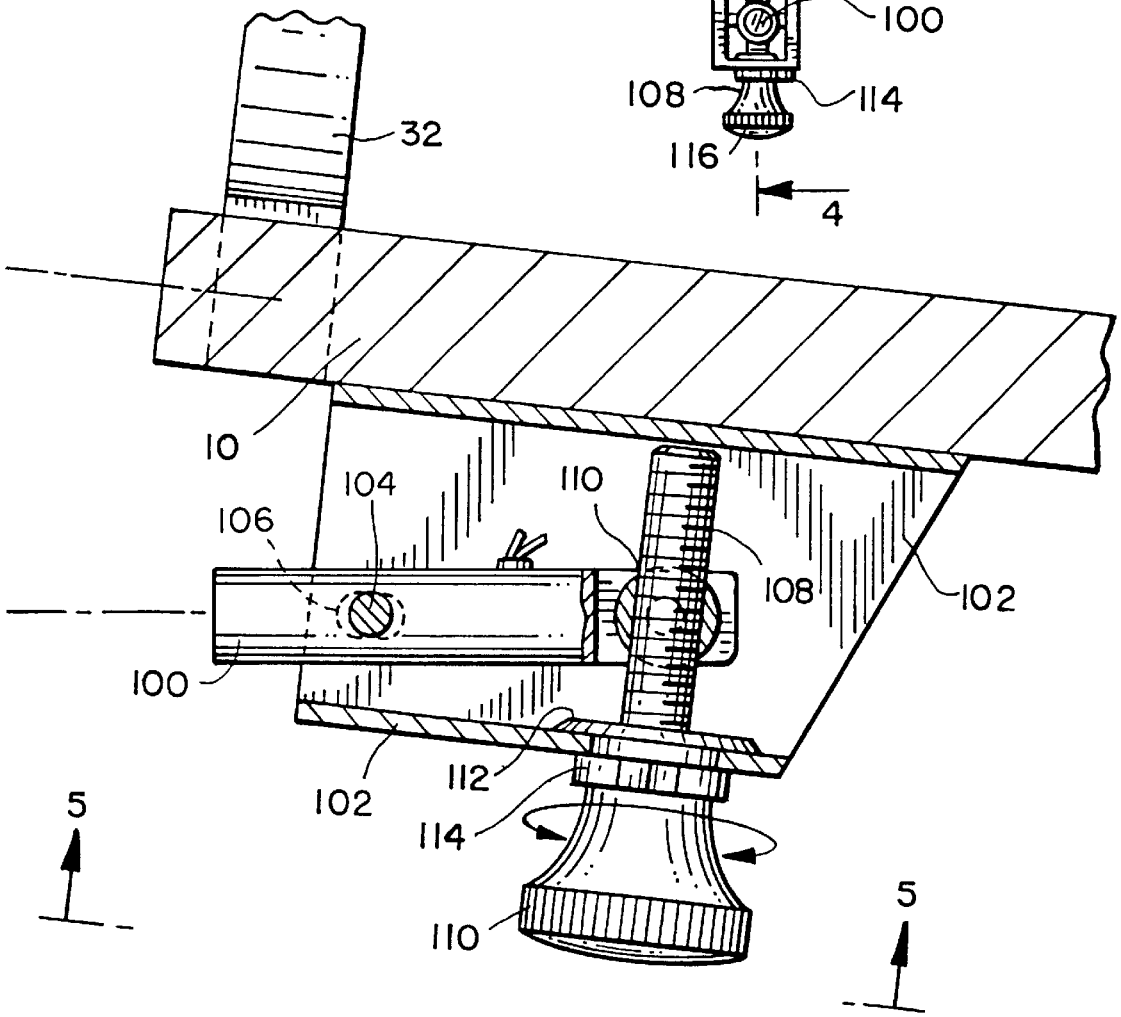
FIG. 4 is a cross section view of a laser beam source taken on plane 4—4.
Figure 5:
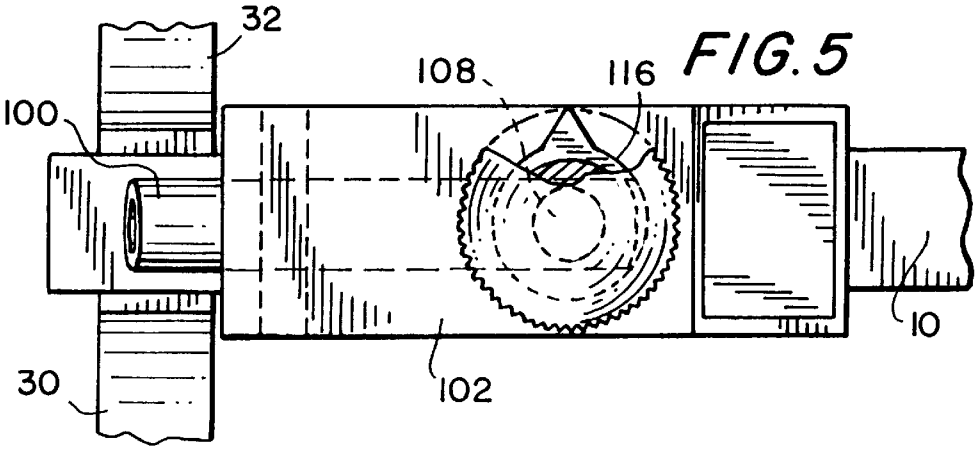
FIG. 5 is a fragmentary view from below seen from plane 5—5 of the adjustably mounted laser beam source.

FIGS. 1, 4, and 5 illustrates the adjustable mounting of a laser beam source 100 positioned at the forward end 22 of the stock 10. The laser beam source 100 is a small battery powered pencil pointer device available on the market and currently in common use.

The laser beam source 100 is pivotally mounted in vertically downward extending fitting 102 attached to the lower side of the stock 10. The barrel of the laser beam source is mounted on a pivot member 104 mounted through an elongated opening 106. The angle of the laser beam source with respect to the stock 10 is adjustably fixed by means of a threaded bolt 108 threadably engaged in a threaded aperture 110 passing vertically through the rearward section of the laser beam source case 100. The threaded bolt 108 is secured to the fitting 102 in a freely rotatable mount secured by retainer nuts 112, 114. The angular position of the laser beam source 100 is indicated by the retainer position of the threaded bolt head 116.

The following schedules relate to the vertical angle adjustment of the laser beam source with respect to the sling shot stock for the given projectile muzzle or initial velocities and the given distances to the target:

a) projectile initial velocity 90 miles/hour or 132 feet/second
   distance to target: 200 yards–600 feet;
   time of flight: 4.5 seconds
   calculated vertical deviation from flat or straight line trajectory neglecting friction
   effects: s=331.24 feet.
   Required angle correction from horizontal 28.9°.

b) projectile initial velocity 70 miles/hour 102.6 feet/second
   distance to target: 34.2 yards=102 feet
   time of flight: 0.18 sec calculated vertical deviation from flat or straight line trajectory
   neglecting friction effects s=32 ft;
   Required angle correction from horizontal arctan 0.321=17.8° c) projectile initial velocity 110 mph=161.3 ft/sec
   distance to target 10 yards=30 feet
   time of flight: 0.18 seconds
   vertical deviation at target from horizontal s=5.76 feet
   required angle correction from horizontal arctan 0.192=10.9°

The initial velocity of the projectile is varied depending upon the energy stored in the elastomer 26. Greater tension in the elastomer 26 achieved by greater expansion (stretching) increases the stored energy available to accelerate the projectile upon release of the elastomer. Typical projectile initial velocities are in the range of 60 miles per hour to 120 miles per hour. Compact dense projectiles for a given initial velocity carry greater momentum (mass times velocity) than less dense projectiles. Accordingly the friction effects will appear to be greater on similarly shaped less dense projectiles i.e. plastic than more dense i.e. metal projectiles.

The laser beam source fixed to the sling shot stock provides the marksman with a visual straight line of sight marker to the target. By adjusting the elastomer tension and thereby the projectile initial velocity and making an estimate of distance to target the marksman may adjust the angle with the horizontal to compensate for selected projectile initial velocity and distance to the target. Thus the target accuracy of my sling shot may be significantly improved over earlier sling shot devices.

It is to be understood that the above description is intended to be illustrative and not restrictive. Many other embodiments will be apparent to those skilled in the art. The scope of the invention-should therefore be determined with reference to the claims, along with the full scope of equivalents for which such claims may be interpreted.

What is claimed is:

1. An improved elastomer powered projectile slingshot device comprised of a stock having an upper and a lower side and a forward end and a rear end, an elongated elastic member, parallel brackets mounted to the upper side at the forward end of the stock, the ends of the elastic member being attached respectively to the parallel but separated brackets, a projectile pouch for holding but rapidly releasing a projectile, a trigger actuated adjustable retaining bracket mounted on the upper side rear end of the stock, and a laser beam source mounted for adjustable vertical angle position of the beam to the lower side forward end of the stock, whereby the elastomer when strained maybe removably attached to the projectile pouch and the retaining bracket, the angle of the laser beam source maybe vertically adjusted to correct for the deviation of the projectile trajectory to accommodate the elastomer tension and resulting projectile velocity, and the estimated target distance, thereby to provide an improved target aiming slingshot.

2. A slingshot according to claim 1 in which the laser beam source having forward and rearward sections is pivotally mounted on the underside of the stock, a threaded bolt, said bolt rotationally secured to the mounting and said bolt threadedly engaged with the rearward portion of the laser beam source wherein the laser beam source angle with respect to the stock may be incrementally adjusted by rotation of the threaded bolt.

3. A slingshot device for propelling a projectile comprised of an elongated stock, an elongated elastomeric member, parallel bracket members, the bracket being mounted at the forward end of the stock, the elastomeric member ends being securely attached respectively to the respective brackets, a laser beam source, adjustable mounting means for the laser beam source, the laser beam source being mounted at the forward end of the stock, whereby when a projectile, held in the extended elastomer at the rear end of the stock in preparation of release and the laser beam is vertically adjustably focused on the target accounting for the velocity of the projectile upon release and the estimated distance to the target, an improved target accuracy is achieved.

* * * * *